US007297089B2

(12) United States Patent
Chen

(10) Patent No.: US 7,297,089 B2
(45) Date of Patent: Nov. 20, 2007

(54) LIGHTED TRAMPOLINE

(76) Inventor: Samuel Chen, Flat M, 3 floor, Kaiser Estate Phase 3, Hok Yuen Street, Kowloon (CN)

( * ) Notice: Subject to any disclaimer, the term of this patent is extended or adjusted under 35 U.S.C. 154(b) by 0 days.

(21) Appl. No.: 11/292,816

(22) Filed: Dec. 2, 2005

(65) Prior Publication Data

US 2006/0135321 A1 Jun. 22, 2006

Related U.S. Application Data

(63) Continuation-in-part of application No. 11/018,196, filed on Dec. 21, 2004, now abandoned.

(51) Int. Cl.
*A63B 5/11* (2006.01)
*A63B 15/02* (2006.01)

(52) U.S. Cl. ..... 482/27; 482/1

(58) Field of Classification Search ..... 482/27–29, 482/1; 5/666, 905

See application file for complete search history.

(56) References Cited

U.S. PATENT DOCUMENTS 3,838,744 A * 10/1974 Tanji et al. ..... 177/177
3,853,191 A * 12/1974 Yamagiwa ..... 177/210 R
4,191,268 A * 3/1980 Miyoshi et al. ..... 177/210 C
4,516,767 A * 5/1985 Eskijian ..... 482/27
4,720,789 A * 1/1988 Hector et al. ..... 463/33
4,742,437 A * 5/1988 Downey ..... 5/666
4,924,743 A * 5/1990 Tsai ..... 84/476
5,141,065 A * 8/1992 Maxwell et al. ..... 177/210 R
5,584,779 A * 12/1996 Knecht et al. ..... 482/8
5,813,946 A * 9/1998 Lin et al. ..... 482/27
5,901,391 A * 5/1999 Kato ..... 5/666
6,145,142 A * 11/2000 Rechin et al. ..... 5/706
6,261,207 B1 * 7/2001 Publicover et al. ..... 482/27
D462,103 S * 8/2002 Chen ..... D21/797
6,758,753 B1 * 7/2004 Nagata et al. ..... 463/36
7,060,000 B2 * 6/2006 Carlson ..... 482/1
2004/0259689 A1 * 12/2004 Wilkins et al. ..... 482/8
2005/0043122 A1 * 2/2005 Publicover et al. ..... 473/465

* cited by examiner

*Primary Examiner*—Stephen R. Crow
*Assistant Examiner*—Allana Lewin
(74) *Attorney, Agent, or Firm*—Clement Cheng, Esq.

(57) ABSTRACT

A trampoline having a frame, a bounce member and a bounce sensor, sensing bounces activates lights and provide sounds for entertainment and training purposes. A control box interprets a variety of inputs from the bounce sensors and outputs a variety of lights and sounds. A light is activated underneath the bounce member when the bounce sensor senses a bounce. One are more sets of lights can be used. The best mode is a spring post configuration sensor. The lights can be encapsulated within a plastic lamination having an upper clear surface and a lower reflective surface.

15 Claims, 6 Drawing Sheets

LIGHTED TRAMPOLINE

This application is a continuation in part of application Ser. No. 11/018,196 filed Dec. 21,2004 now abandoned by Samuel Chen for an Illuminated Trampoline, the disclosure of which is incorporated herein by reference. This application claims a priority date of Nov. 9, 2005 from provisional application mailed by express mail EQ189663142US.

DISCUSSION OF RELATED ART

Trampolines have been a fun and exciting backyard exercise. Learning to trampoline requires learning timing. A variety of somersaults, flips and pikes can be learned and developed into a choreographed routine. To reach a proficient level, training aids can help.

A variety of trampoline structures have been created since the traditional steel frame trampoline with nylon sheet supported by springs. One of the newer structures includes inflatable bounce member having air bounce replacing springs. In either case, trampoline instruction is specialized and individual personal training services are expensive. Therefore, trampoline aids and accessories are oftentimes helpful for the amateur backyard enthusiast.

Unfortunately, trampoline accidents are common among novice enthusiasts. Oftentimes, children may jump outside the trampoline mat landing on the frame or ground. It is an object of the invention to lower the trampoline accident rate as well as provide for a more enjoyable and entertaining trampoline structure.

DETAILED DESCRIPTION OF THE PREFERRED EMBODIMENT

The invention includes lights and sound created when a bounce sensor on the bounce member senses a bounce.

For the traditional steel frame and sheet supported by springs, a bounce sensor can be formed as an electrical contact switch, a pressure gauge, a strain gauge or a piezoelectric element. The preferred mode is a pull switch mounted to the spring or sheet. Pull switches are commonly sold having two positions and may include a brass body and knob mounted on a washer and nut threaded portion. The switches often contain stainless steel springs for durability.

Although these switches are commonly known and commonly available in electrical supply stores, new designs for these switches have appeared in United States patents. For example, Dutkiewicz U.S. Pat. No. 6,743,996 issued Jun. 1, 2004 provides a pull chain switch having a spring of a first stiffness mounted with a spring of a second stiffness. U.S. Pat. No. 6,743,996 is incorporated herein by reference. In any case, a pull switch of old design or new design is sufficient as long as it acts as a sensor of the bounce.

Figure 1:
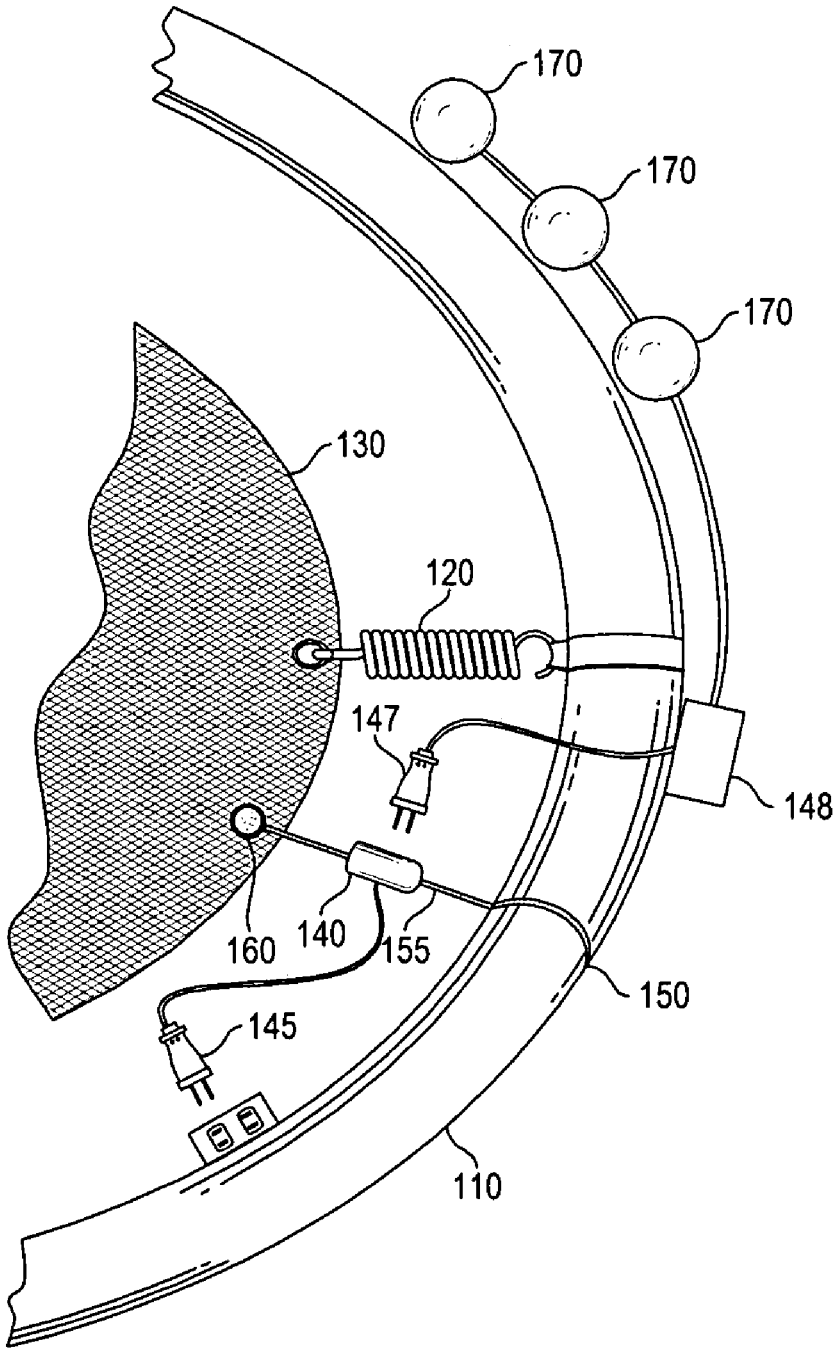
FIG. 1 is a close up view of the bounce sensor mounting.

FIG. 1 shows a perspective view of a trampoline. The frame 110 is connected to a spring 120 that is connected to a bounce member 130 formed as a sheet commonly made of nylon material. When a user lands on the trampoline bounce member 130 a plurality of springs 120 retain potential energy and bounce the user. A switch 140 can be attached to the frame at a frame switch connection 150. The frame switch connection 150 is preferably an elastic cord 155. The switch can be attached to the bounce member 130 by a bounce member switch connection 160. An elastic cord 155 can also make the bounce member switch connection 160.

When the user lands on the trampoline bounce member 130, the switch 140 is pulled so that it completes a circuit. The switch 140 if based on standard 120 V AC power can be plugged via plug 145 into a standard socket. The switch can also have a standard socket capable of receiving a standard plug 147. In the preferred embodiment, the plug 147 is attached to a voltage transformer 148 that transforms the electricity to DC power. The electricity is then used to light lighting elements 170 that can be mounted on the frame 110. The lights can be of commonly available LED's, incandescent or fluorescent technology.

Figure 2:
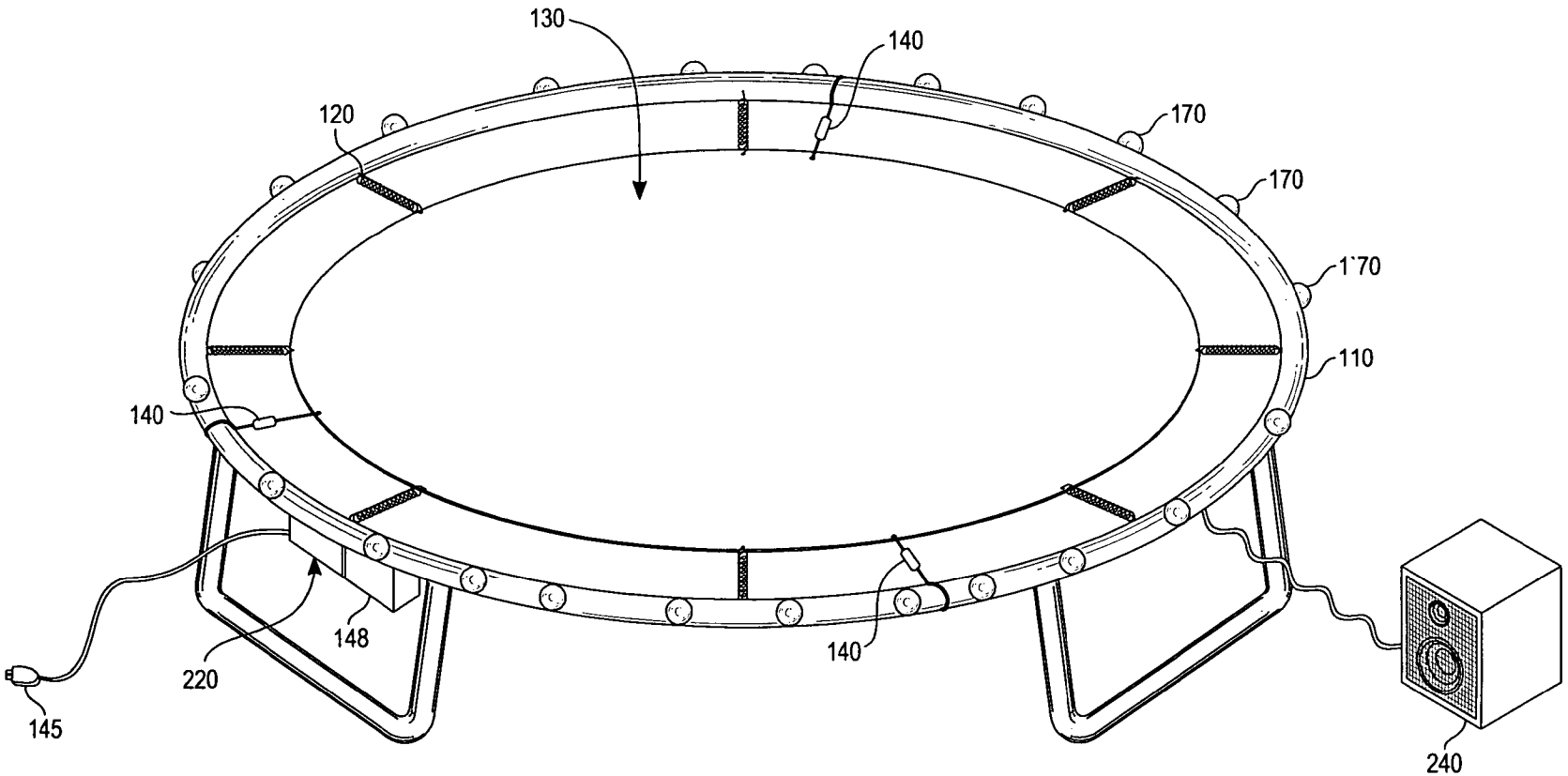
FIG. 2 is a perspective system view of the trampoline.

FIG. 2 is an alternate view of the invention, showing three bounce sensors 140 that are pull switches. Three bounce sensors 140 should be used so that differences in spring rigidities 120 may have less impact on sensor calibration. Also, having three sensors 140 allows backup in case of sensor failure.

The additional element shown in FIG. 2 is a control box 220 having a CPU that is preferably an integrated circuit or circuit board such as a PCB to control the logic of the light illumination 170. Typical pull switches complete a circuit when the pull switch is pulled. Some switches complete a circuit on a first pull and open a circuit on a second pull. Therefore, the control box 220 having a CPU can accommodate different switches and provide different outputs.

Also, bounce sensors have varying levels. A bounce sensor such as a pull switch may sense a strong pull and a weak pull. Also, the control box 220 may count the number of pulls before activating lights. The control box may also activate the lights in a flashing, intermittent, constant or random mode. For example, the control box may be programmed to provide no light output on a first pull, a short flash of light output on a second pull, a continuous on light on a fourth pull and a reset of the program on an eighth pull. The control box can thus be programmed to remind a user of the number of bounces. In a random mode, the control box 220 can provide for example, no light output on a first pull, a, random number of flashes of light output on a second pull, and from 3 to 7 flashes of light on a fourth pull. The random mode can be used for entertainment purposes.

In the inflatable trampoline embodiment, the bounce sensor is a differential pressure switch. A variety of pressure sensors are also commonly available. Commonly available pressure transducers have a wide temperature range and can output a wide voltage range depending on application. Such sensors are small and can measure pressures from vacuum to thousands of PSI. Although pressure transducers are basically equivalent to switches, they do not need to be mounted to the wall of the bounce member and could be placed inside the bounce member.

Because of the current application, the pressure sensor does not need to be of high accuracy as compared to other industrial applications.

In the case of an inflatable trampoline, the bounce member and inflatable frame are often semi translucent. Thus, illumination elements 170 can be placed within the bounce member or in inflatable frame.

Figure 3:
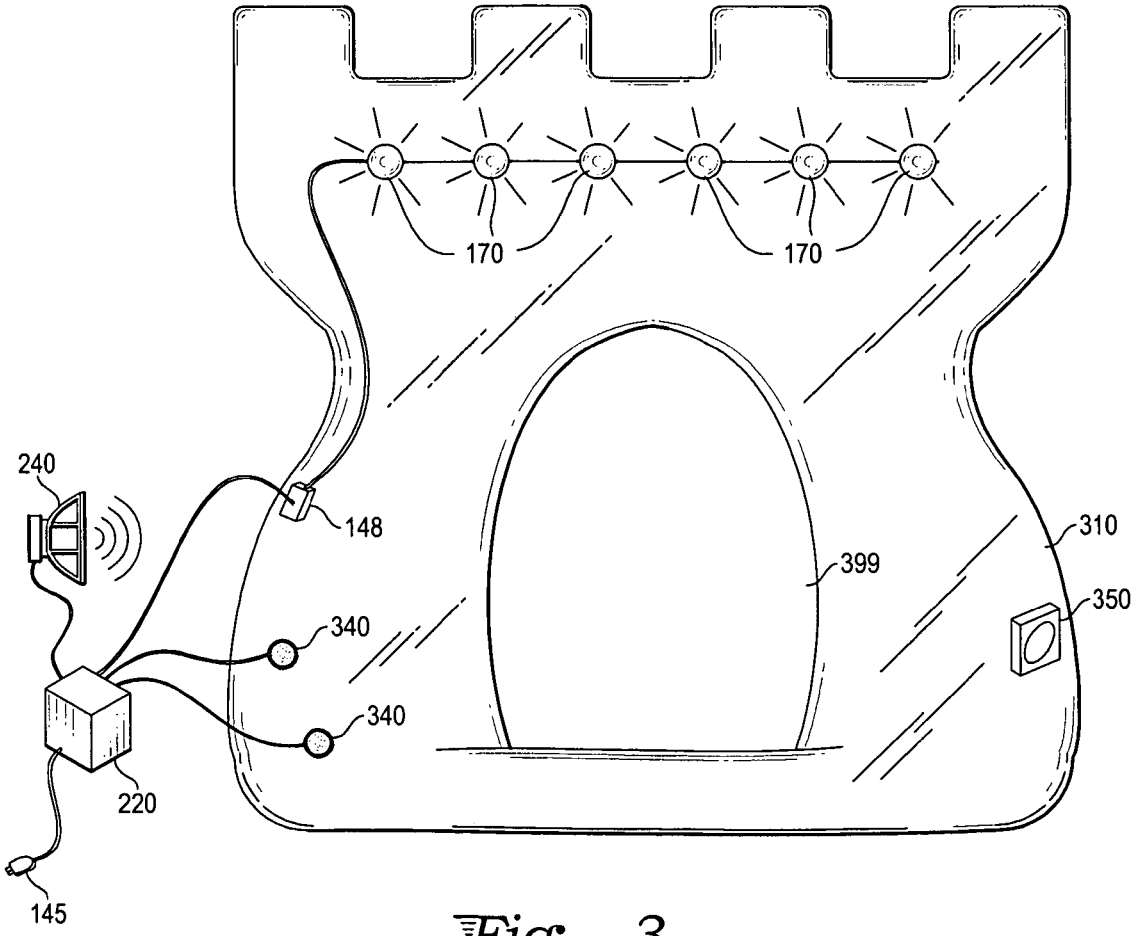
FIG. 3 is a diagram of an inflatable trampoline having a castle theme.

FIG. 3 shows an inflatable trampoline having a castle theme. The entrance 399 is shaped as a drawbridge suggesting a castle shape. The inflatable castle has a fan 350 inflating the frame enclosure 310 and bounce member 130. The bounce member is preferably connected to the frame enclosure 310 such that air communicates between the frame enclosure 310 and bounce member 130. Oftentimes, the frame enclosure and bounce member are integrally formed and lacking perceptible demarcation. The air pressure sensor 340 can be placed inside the inflatable portion, or mounted on the wall of the inflatable enclosure. The air pressure sensor sends input data to a control box 220. The control box plugs into electricity by plug 145. The control box optionally sends output to a voltage transformer that controls lights mounted on the inside or outside of the frame enclosure 310. The control box 220 also outputs audio signals to a speaker 240. In the case of an inflatable trampoline, the bounce member and inflatable frame are often semi translucent. Thus, illumination elements 170 can be placed within the bounce member or in the inflatable frame.

The control box can be programmed to provide light when it is sensing a bounce, or provide a certain number of minutes of uninterrupted light upon a bounce, or switch the lights on and off with each bounce, or a wide variety of different user selected outputs.

The control box can also provide a sound output from a speaker 240. The sound can be stored on flash memory in the control box 220. The control box can provide a simple beat, music, classical music, thematic music, rock-and-roll or other genres. In entertainment modes, the control box can provide sound effects such as animals "moo," "boa," "roar", machinery sounds, cartoon sounds "boing," "gong", celebrity voices & phrases or other user recorded sounds.

The sounds preferably correlate to the bounce sensor input to provide training, or entertainment. For example, a beat can be used in conjunction with light flashing in a training mode. When a user lands on the beat, the lights activate to show proper timing. Optionally, different colored lights such as red, yellow and green lights activate when a user bounces so that a red light activates designating an offbeat bounce, a yellow light activates showing slightly offbeat bounce and a green light activates showing on beat bounce. The beat and bounce can be electronically scored and tallied according to delay time between beat and bounce.

In an entertainment mode, an animal sound such as a roar can activate on a number of bounces. The animal roar sound can be thematically tied to an inflatable trampoline having a lion theme such as a cartoon lion head or otherwise lion decorated inflatable trampoline. Theme music can also be activated on a specified number of bounces and cease when no bounce is detected for a certain amount of time. The theme of music can also be changed depending upon the jumping pattern of the user. A control box can change the music depending upon the user jumping style. This may allow the junior users a way to choreograph their own routines.

Figure 4:
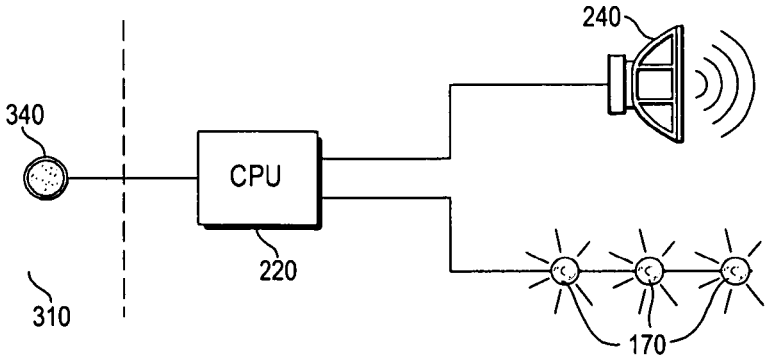
FIG. 4 is an electrical diagram.

FIG. 4 shows a circuit diagram of the trampoline. The trampoline body or frame 310 has a bounce sensor 340 mounted thereon sending data to an optional control box 220 having a CPU. The control box sends outputs to a speaker 240 and light or illumination elements 170.

A bounce, is a motion which can be sensed by a device called a bounce sensor 340. A sound sensor 340 can be a bounce sensor 340, as it senses the motion of vibrations in the air, and is thus a motion sensor 340 tuned to audible or inaudible sound frequencies. The sensor can be a sound sensor that activates at a particular decibel threshold. Here, the sound sensor would be a type of indirect sensor. Common sound sensors 340 are sold as microphones. A mechanical motion sensor senses mechanical vibrations from the trampoline structure such as the frame or bounce pad or spring to which the mechanical motion sensor is attached. A switch that is directly actuated upon bouncing, is also a mechanical motion sensor which is a direct motion sensor. An indirect motion sensor senses motion indirectly from the vibrations caused by the bounce. Therefore, a wide variety of currently and commercially available sensors can be used as bounce sensors.

Figure 8:
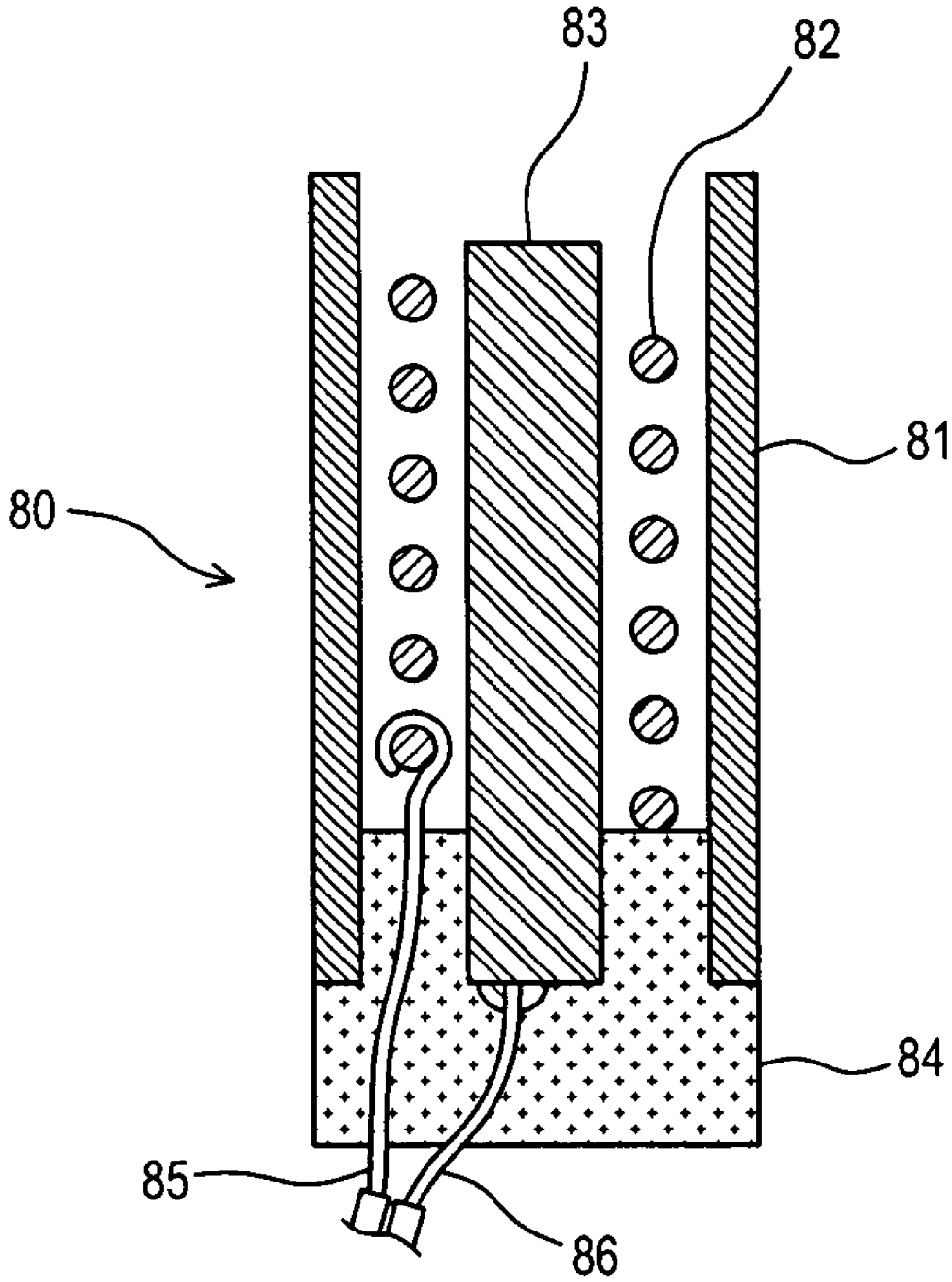
FIG. 8 is a cross section of the best mode bounce sensor.

It is obvious to pick the best type of sensor from the wide array of sensors depending upon the architectural configuration, mechanical construction and artistic theme of the trampoline. For example, a trampoline having an inflatable structure could use a sound sensor or a pressure sensor mounted inside of the inflatable portion of the structure. If a portion of the inflatable structure is filled with water, a sound sensor can also be used. For trampolines having a bounce mat instead of an inflatable section not holding water or air, the vibration sensor shown on FIG. 8 is the best mode, which is the spring post configuration. The best mode bounce sensor 80 in FIG. 8 has a flexible resilient spring 82 that touches a post 83 when vibrated, or moved so that it closes a circuit sending a signal to lights connected on the circuit. There is optionally a sheath 81 mounted on a base 84 holding two sets of wiring. The spring wiring 85 connected to the post wiring 86.

Figure 5:
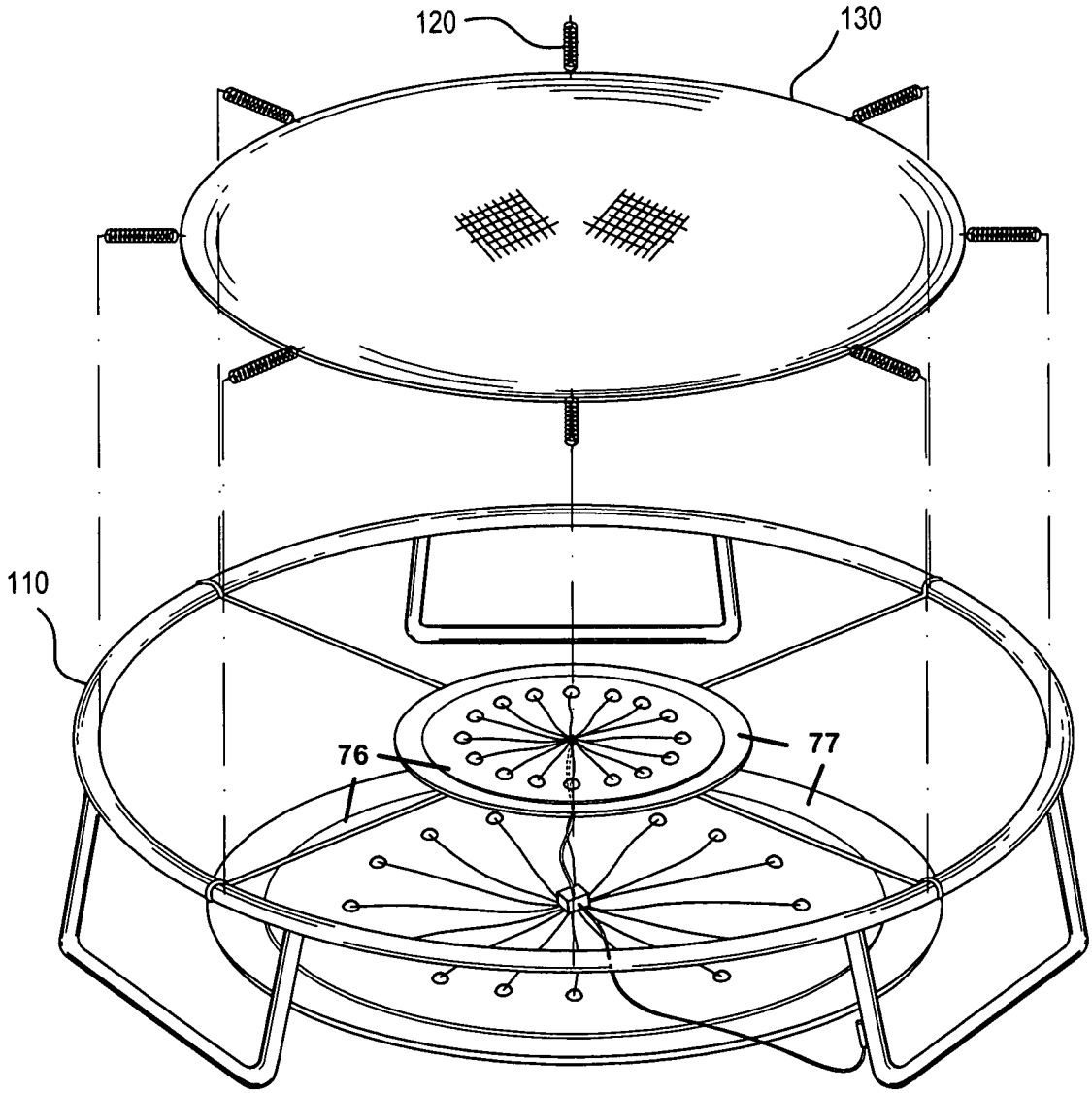
FIG. 5 is and exploded view of the present invention.

The trampoline mat or bounce member shown in FIG. 5 is made of a typical uniform woven plastic fabric mesh that it is partially see-through. The trampoline can be improved by suspending the lights below the trampoline so that deflection of the trampoline mat during use strikes and activates a bounce sensor that controls lights underneath the bounce member. The lights underneath the bounce member provide visual cues so that novice trampoline users can maintain their bouncing in a safe location in the middle of the bounce member close to the sweet spot. The lights underneath can be oriented in a variety of ways, preferably in concentric circles suggesting the relative location of the area bounced upon.

FIG. 5 shows a pair of lights that are mounted to the trampoline. The upper lights are held within a laminated plastic structure having a bottom reflective surface 77 accentuating the illumination, and a top clear plastic 76 allowing light to pass through. This would allow an array of non-directional LED light elements to be arranged and encapsulated within the laminate disk structure. The top set of lights is formed as a circular disk, but need not necessarily be circular. The elastic cord has connection to the circular disk and stretches to the frame of the trampoline. The elastic cord optionally terminates at a clip that clips to the trampoline frame. Other attachment hardware can be used such as a hook, however hardware is not necessary where users are capable of simply tying a knot. The upper disk is shown as connected to the bottom disk, but can be implemented as a separate device by including batteries and logic circuitry in the circular disk laminate reflector.

The bottom disk shows a small box holding batteries and electrical circuitry. The sensor is mounted to the frame at a vertical portion of a U shaped frame leg. The sensor can also be mounted to the trampoline bounce member, or other part of the system that moves when the trampoline is in use.

As shown, the bottom set of lights is also encapsulated within a laminate disk having a bottom reflective surface and a top clear surface. The bottom set of lights can also be called the bottom disk, just as the top set of lights can be called the top disk when the lights create a disk configuration. The bottom disk in this case is not strapped to the frame, and is laying on the ground. If the ground is muddy or wet, elastic cords can be provided to connect the bottom disk to the frame. The elastic cords that suspend the bottom disk to the frame can be the same as the ones that connect the top disk to the frame. Although the elastic material is shown with relatively little slack, slack is not necessarily undesirable.

Figure 6:
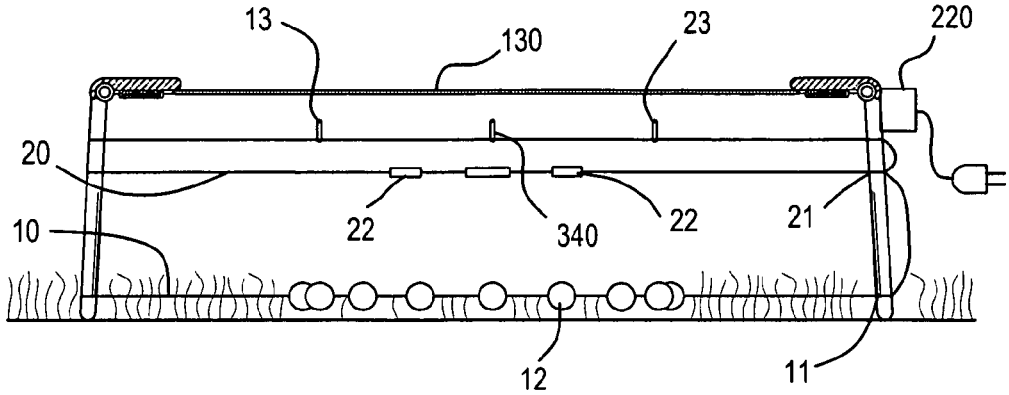
FIG. 6 is a cross section of the present embodiment.

FIG. 6 shows grass ground as a side view so that the first set of lights can be placed along the ground within the height of the grass. The side view also shows that the trampoline mat is the top surface above the sensors, which are above the second set of lights, which are above the first set of lights. The first set of lights 10 is connected at a first light set connection 11 to the frame. The second set of lights 20 is connected at a second light set connection 21 to the frame. The connection hardware again can be a clip, hook, knot or an equivalent thereof.

The bounce sensor can be implemented in the cross sectional configuration as seen in FIG. 6. The box control 220 housing the CPU can be mounted on the frame of the trampoline. The control box can also be mounted on the lights or suspended. The control box is shown in the exaggerated scale here for clarity and the actual control box should be much smaller than this. Because the control box is small, there is wide latitude in its placement. Although there is wide latitude in its placement, common sense would suggest that placing the box on top of the mat might present an obstacle to users.

As seen in FIG. 6, a first set of safety lights 10 is placed on the ground and has a plurality of first lights 12 activated by a first bounce sensor 13. The elastic cord, or semi elastic cord of the first set of safety lights 10 is shown as a completely horizontal line here for sake of clarity. Slack in the arrangement or installment is not necessarily undesirable.

Although the LED lights may be small, translucent plastic globes providing a different aesthetic feel can encapsulate the lights. The Christmas light look provides a more traditional look. In any case, the first set of lights shown as globes in FIG. 6 is basically the same as the laminated structure found in FIG. 5. The laminated structure provides a more modem look. The laminate structure is preferred for cost, ease of construction and maintenance. The Christmas lights look may be preferred in certain types of inflatable structures that would have a theme consistent with such a look.

A second light set 20 is attached to the frame and pulled taught or semi taught underneath the frame. A second bounce sensor 23 activates the second set 20. A second bounce sensor 23 can be closer to the middle of the trampoline mat bounce member 130. It is possible to make the second bounce sensor 23 sound activated and the first sensor 13 motion activated. The electroluminescent line lights 22 can also be implemented as LED illuminated translucent light tubes. The second lights 22 are shown as individual elements, but can also be encapsulated by plastic sheeting between an upper clear section of plastic and a lower reflective sheet. The reflective face faces up so that light can be directed upward toward persons. The control box 220 can be mounted underneath the plastic sheeting of either the first 12 or second lights 22.

Figure 7:
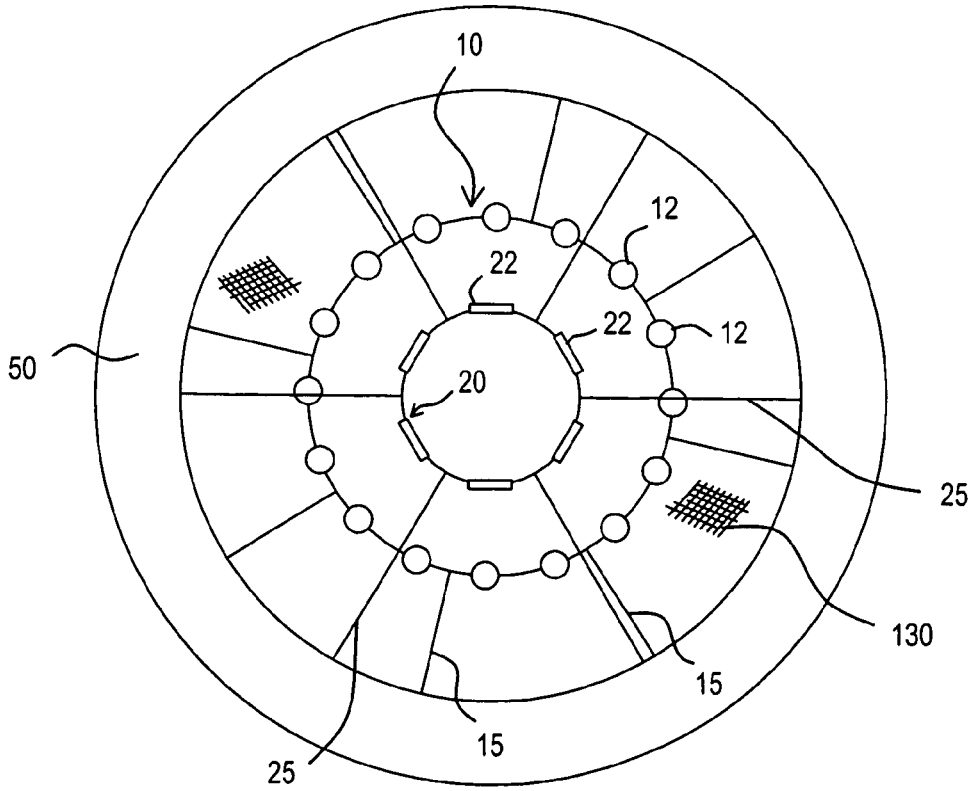
FIG. 7 is a top diagram of the new embodiment.

A second set of lights 20 has a plurality of second lights 22 that are shown here as electroluminescent line lights FIG. 7, rather than the point lights 12 of the first set that could be LED element or incandescent. Any variety of lights in any arrangement can be used depending upon the decorative theme. Here, the second set 20 at a second level is above the first set 10 at ground level.

The first bounce sensor 13 can be placed in a different location than the second bounce sensor 23 so that a user depressing a different region of the bounce member can activate a different set of lights. The lights can also be connected to sounds so that different sounds are associated with different lights.

FIG. 7 is a top view and shows the circumferential padding region 50 around the edges of the trampoline. The padding region is typical and commonly used in trampolines. The padding region 50 protects against accidental falls on the frame 110 or springs 120 of the trampoline. The padding region may be implemented as a plurality of sections.

The embodiment shown in FIG. 7 has a number of first light set connecting supports 15, and second light set connecting supports 25 allowing a variety of lights suspended, or placed below the trampoline bounce member. The lights and connecting members receive wiring to the control box 220 that can be plugged into an electricity source. Instead of plugging into the wall with ordinary alternating house current, the trampoline electrical components can also be battery-powered, or solar powered if cost feasible.

A generic bounce sensor 340, FIG. 6 can activate both sets of lights, or operate in accordance with preprogrammed logic and other bounce sensors so that different bounce sensors activated will cause a particular light pattern to emerge. The preprogrammed logic can be complicated such as in playing a puzzle game where different bounce sensors and lights must be activated in a particular order to solve a puzzle. On the other hand, the preprogrammed logic can be very simple such as activating the lights for a set or random duration whenever bounce sensors are activated. The logic can be programmed on to the control box 220. The control box may house a CPU or other silicon processor such as a printed circuit board or other miniaturized chip. The control box can also be mounted below the trampoline if it is miniaturized so as to be unobtrusive.

Although the figures show a first lower outside point light configuration below a second inside upper circle configuration in line luminescent configuration, the trampoline specific configuration can be implemented so that either the upper or lower set of lights has the line or point configuration, and so that either the inner or outer set of lights is the upper or lower set of lights. It is also feasible to add additional sets of lights, or sensors in various logical configurations if cost justified. The lights below the trampoline can also be combined with lights attached to the frame. The lights can also respond in unison with sound effects.

In general, the safety aspects of the lighted configuration are to prevent accidents. The lights orient the user assisting bounce control. The lights also attract children toward the center of the trampoline so that they do not fall off the edge. Therefore, there are a wide variety of logical patterns, themes and specific configurations that can be implemented to achieve these goals.

The foregoing describes the preferred embodiments of the invention. Modifications may be made without departing from the spirit and scope of the invention as set forth in the following claims. The present invention is not limited to the embodiments described above, but encompasses any and all embodiments within the scope of the following claims. For ease of reference, a call out list of elements is provided below.

CALL OUT LIST OF ELEMENTS

10 First Set Of Safety Lights
12 Point Lights
13 First Bounce Sensor
15 First Light Set Connecting Supports
20 Second Set Of Lights
22 Second Lights
25 Connecting Supports
76 Top Clear Plastic
77 Reflective Surface
80 Bounce Sensor
81 Sensor Sheath
82 Sensor Flexible Resilient Spring
83 Sensor Post
84 Sensor Base
85 Sensor Spring Wiring
86 Sensor Post Wiring
110 Trampoline Frame
120 Trampoline Spring
130 Bounce Member
140 Bounce Sensor
145 Plug For Switch
147 Plug For Light Elements
148 Electrical Transformer
150 Bounce Sensor Connection To Frame
155 Elastic Cord
160 Bounce Sensor Connection To Switch
170 Light Elements
220 Control Box
240 Speaker

The invention claimed is:

1. A trampoline comprising:

a. a frame;

b. a bounce member that a person can bounce upon; the bounce member connected to the frame, wherein the bounce member has a top surface at least partially pervious to light;

c. a bounce sensor, sensing bounces; a light activated underneath a top surface of the bounce member when the bounce sensor senses a bounce; wherein the bounce sensor has a vibration spring post configuration that has a flexible resilient spring that touches a post when vibrated, or moved so that the spring post contact closes a circuit sending a signal to lights connected on the circuit; wherein the frame and bounce member are formed as inflatable sections.

2. The trampoline of claim 1, wherein the light is formed a plurality of individual light elements.

3. A trampoline comprising:

a. a frame;

b. a bounce member that a person can bounce upon; the bounce member connected to the frame, wherein the bounce member has a top surface at least partially pervious to light;

c. a bounce sensor, sensing bounces; a light activated underneath a top surface of the bounce member when the bounce sensor senses a bounce; wherein the bounce sensor has a vibration spring post configuration that has a flexible resilient spring that touches a post when vibrated, or moved so that the spring post contact closes a circuit sending a signal to lights connected on the circuit; wherein the light is formed as a plurality of individual light elements and further comprising an elastic cord attaching the frame to the light.

4. The trampoline of claim 3, wherein the light is encapsulated within a plastic laminate having a clear upper surface and a reflective lower surface.

5. The trampoline of claim 3, wherein the bounce sensor has a vibration spring post configuration.

6. The trampoline of claim 3, wherein the control box has logic circuitry electrically connected to the light and batteries to power the light and preprogrammed game logic.

7. The trampoline of claim 3, wherein the bounce sensor is a sound sensor.

8. A light and trampoline device comprising:

a. a plurality of elastic cords;

b. a light formed as a plurality of individual light elements, wherein one of the elastic cords attach between a connector and one of said individual light elements light;

c. a bounce sensor, sensing bounces and activating the light when a bounce is sensed wherein the bounce sensor has a vibration spring post configuration that has a flexible resilient spring that touches a post when vibrated or moved so that the spring post contact closes a circuit sending a signal to said plurality of individual light elements connected on the circuit; and d. a trampoline bed and trampoline frame wherein the plurality of elastic cords is attached to the trampoline bed and trampoline frame.

9. The light and trampoline device of claim 8, further comprising a control box having logic circuitry electrically connected to the light and batteries to power the light.

10. The light and trampoline device of claim 9, wherein the light is encapsulated within a plastic laminate having a clear upper surface and a reflective lower surface.

11. The light and trampoline device of claim 10, wherein the bounce sensor is a sound sensor.

12. The light and trampoline device of claim 11, wherein the control box has logic circuitry electrically connected to the light and batteries to power the light and preprogrammed game logic.

13. The light and trampoline device of claim 8, wherein the light is encapsulated within a plastic laminate having a clear upper surface and a reflective lower surface.

14. The light and trampoline device of claim 8, wherein the bounce sensor is a sound sensor.

15. The light and trampoline device of claim 8, wherein the control box has logic circuitry electrically connected to the light and batteries to power the light and preprogrammed game logic.

* * * * *